US010674278B2

(12) United States Patent
Zhou et al.

(10) Patent No.: US 10,674,278 B2
(45) Date of Patent: Jun. 2, 2020

(54) MULTI-FUNCTION SPEAKER

(71) Applicant: AAC Technologies Pte. Ltd., Singapore (SG)

(72) Inventors: Jiasheng Zhou, Shenzhen (CN); Long Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/535,069

(22) Filed: Aug. 8, 2019

(65) Prior Publication Data

US 2020/0059731 A1 Feb. 20, 2020

(30) Foreign Application Priority Data

Aug. 17, 2018 (CN) ..... 2018 2 1335401 U

(51) Int. Cl.
*H04R 9/06* (2006.01)
*H04R 9/02* (2006.01)

(52) U.S. Cl.
CPC ..... *H04R 9/06* (2013.01); *H04R 9/025* (2013.01); *H04R 2400/11* (2013.01)

(58) Field of Classification Search
CPC ..... H04R 9/06; H04R 9/025; H04R 2400/11
See application file for complete search history.

(56) References Cited

U.S. PATENT DOCUMENTS

2016/0173990 A1* 6/2016 Park ..... H04R 1/06

* cited by examiner

*Primary Examiner* — Mark Fischer
(74) *Attorney, Agent, or Firm* — W&G Law Group LLP

(57) ABSTRACT

The present disclosure provides a multi-function speaker, which includes a frame having a housing space, a magnetic circuit system and a vibration system accommodated in the housing space, an elastic body configured to suspend the magnetic circuit system in the housing space of the frame. The elastic body fixed to the frame includes two elastic pieces having the same structure. The magnetic circuit system comprises a lower plate, a primary magnet, a secondary magnet and an upper plate disposed on the secondary magnet. The upper plate includes a protrusion, the elastic piece includes a first fixed portion fixedly connected to the first side wall, a second fixed portion fixedly connected to the protrusion, and an elastic portion.

10 Claims, 8 Drawing Sheets

MULTI-FUNCTION SPEAKER

FIELD OF THE DISCLOSURE

The present disclosure relates to electro-acoustic conversions, and more particularly to a multi functional speaker applied in a portable electronic product.

DESCRIPTION OF RELATED ART

A speaker in the related art includes a frame having a housing space, a vibration system, a magnetic circuit system and an elastic member. The magnetic circuit system is suspended in the housing space of the frame by the elastic member.

The magnetic circuit system includes a yoke, a primary magnet and a secondary magnet received in the yoke. The primary magnet and the secondary magnet form a magnet assembly accommodated in the yoke, and a magnetic gap is formed between the magnetic assembly and the yoke. The vibration system includes a diaphragm and a voice coil. One end of the voice coil is suspending in the magnetic gap, and the other end of the voice coil fixed to the diaphragm. The elastic member includes an elastic arm and a fixed arm that are connected to each other, the fixed arm is fixed to the frame and the secondary magnet.

In the related art, the structure of the speaker provides the fixed arm fixed to the secondary magnet, and a length of the fixed arm is small, that is, the fixed arm is shorter. Therefore, the structure of the speaker in the related art results a larger f0 of the multi-function speaker when the speaker operates at low frequencies, thereby limiting the performance of the multi-function speaker.

Therefore, it is desired to provide a multi-function speaker to overcome the above problem.

BRIEF DESCRIPTION OF THE DRAWINGS

Various aspects of an exemplary embodiment may be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the drawings.

DETAILED DESCRIPTION

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
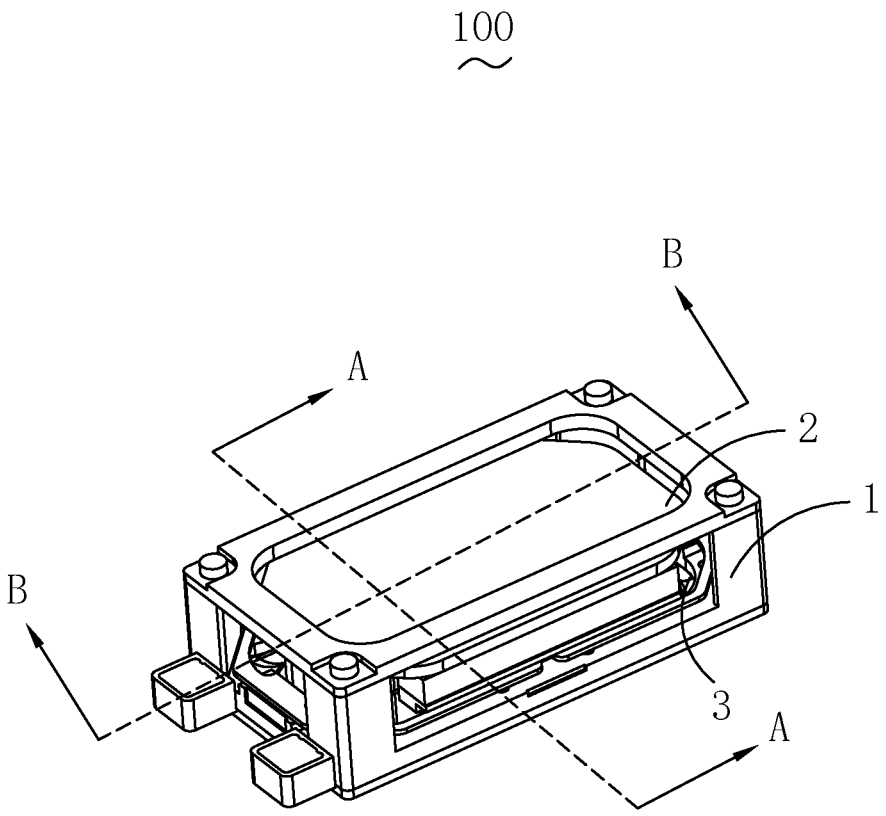
FIG. 1 is an isometric view of a multi-function speaker according to the present disclosure.
Figure 2:
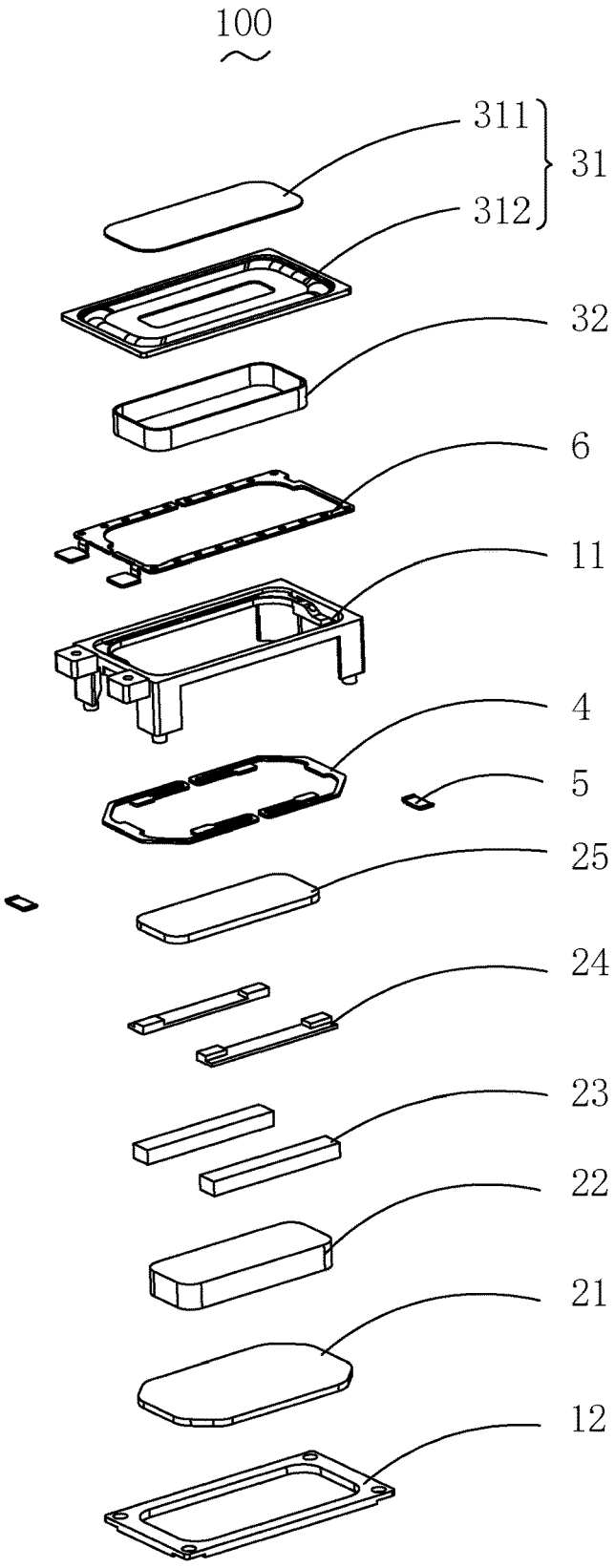
FIG. 2 is an exploded view of the multi-function speaker according to the present disclosure.

Please also refer to FIG. 1 and FIG. 2, wherein FIG. 1 is an isometric view of a multi-function speaker according to the present disclosure, and FIG. 2 is an exploded view of the multi-function speaker as illustrated in FIG. 1. The present disclosure provides a multi-function speaker 100. The multi-function speaker 100 includes a frame 1 having a housing space, a magnetic circuit system 2, a vibration system 3 and an elastic body 4. The magnetic circuit system 2 and the vibration system 3 are accommodated in the housing space of the frame 1. The elastic body 4 is fixed to the frame 1 and is configured to suspend the magnetic circuit system 2 in the housing space.

The frame 1 includes an upper shell 11 fixedly connected to the vibration system 3 and a lower shell 12 fixedly engaged with the upper shell 11 to form the housing space correspondingly. The upper shell 11 includes two first side walls 13 oppositely disposed to each other and two second side walls 14 oppositely disposed to each other. The second side walls 14 are configured to connect the first side walls 13 respectively.

The magnetic circuit system 2 includes a lower plate 21, a primary magnet 22 disposed on the lower plate 21, both secondary magnets 23 disposed on both opposite sides of the primary magnet 21 in a direction parallel to the second side wall 14, an upper plate 24 disposed on the secondary magnet 23, and a pole core 25 disposed on the primary magnet 22. A height of the secondary magnet 23 is smaller than that of the primary magnet 22 in the vibration direction. The upper plate 24 includes a main body portion 241 which is disposed on the secondary magnet 23 and both protrusions 242 which protrude from both ends of the main body portion 241 in vibration direction and distal from the secondary magnet 23. Projection of the protrusion 242 in a direction perpendicular to vibration direction and perpendicular to the second side wall 14 completely fall within the primary magnet 22.

The vibration system 3 includes a diaphragm 31 configured to vibrate to produce sound, and a voice coil 32 configured to drive the diaphragm 31 to vibrate. In this present embodiment, the diaphragm 31 is a two-piece diaphragm including a dome 311 at a middle position and a suspension 312 surrounding the dome 311. In another embodiment, the diaphragm 31 may also be an integral structure.

Figure 3:
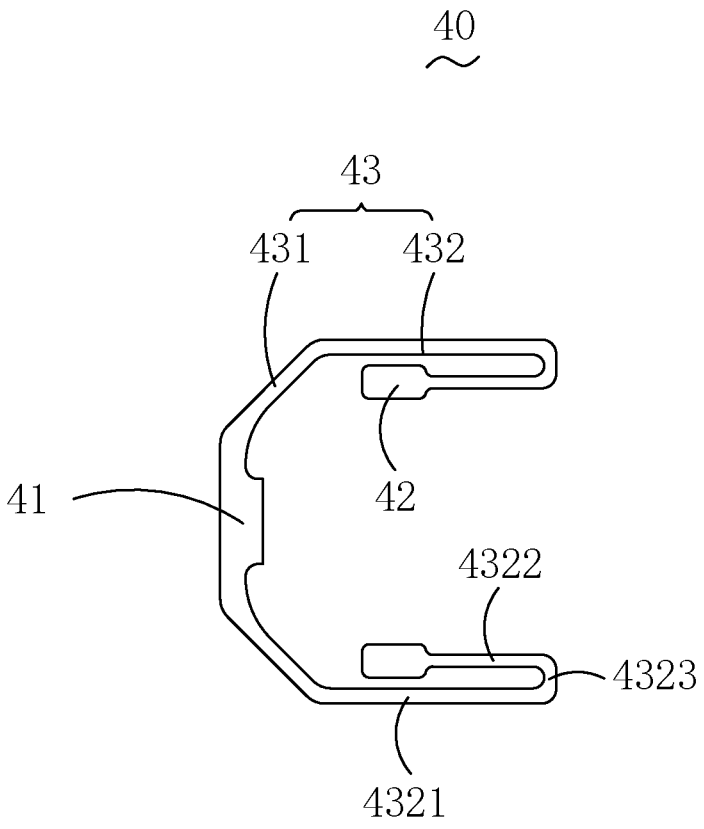
FIG. 3 is a perspective view taken along ling A-A as illustrated in FIG. 1 according to the present disclosure.

As illustrated in FIG. 3, the elastic body 4 includes both elastic pieces 40 of the same structure. The two elastic pieces 40 are symmetrically disposed on both sides of the multi-function speaker 100. The elastic piece 40 includes a first fixed portion 41 fixedly connected to the first side wall 13, a second fixed portion 42 fixedly connected to the protrusion 242 and an elastic portion 43 connecting the first fixed portion 41 to the second fixed portion 42. The elastic portion 43 includes a first elastic portion 431 extending from both opposite ends of the first fixed portion 41 and a second elastic portion 432 extending from one end of the first elastic portion 431. The second elastic portion 432 includes a first elastic arm 4321 proximal to the second side wall 14, a second elastic arm 4322 proximal to the primary magnet 22 and a first connecting arm 4323 connecting the first elastic arm 4321 to the second elastic arm 4322. One end of the first elastic arm 4321 distal from the first connecting arm 4323 is connected to the first elastic portion 431, and one end of the second elastic arm 4322 distal from the first connecting arm 4323 is connected to the second fixed portion 42.

Figure 7:
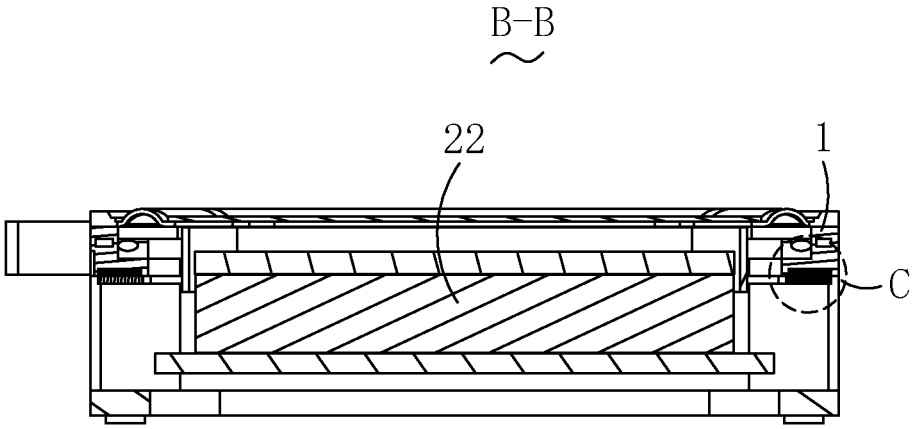
FIG. 7 is perspective view taken along line B-B as illustrated in FIG. 1 according to the present disclosure.
Figure 8:
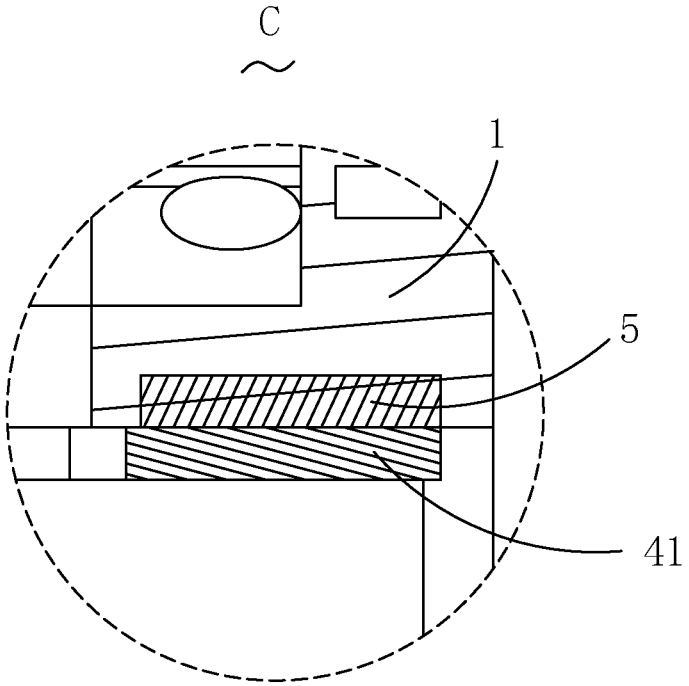
FIG. 8 is a partially enlarged view of part C in the isometric view as illustrated in FIG. 7.

Referring to FIG. 7 and FIG. 8, FIG. 7 is perspective view taken along line B-B as illustrated in FIG. 1, and FIG. 8 is a partial enlarged view of a part C as illustrated in FIG. 7. The multi-function speaker 100 further includes a connecting body 5 connecting the first fixed portion 41 to the first side wall 13 and a conductive terminal 6 configured to connect an external circuit. The connecting body 5 is embedded in the frame 1. By this way, the elastic piece 40 is tightly fixed to the frame 1 and not easy to fall from the frame 1, so that the multi-function speaker 100 has better drop resistance performance.

In this embodiment, the first elastic arm 4321 and the second elastic arm 4322 are parallel to the second side wall 14, and the first connecting arm 4323 is curved. In other embodiments, the first elastic arm 4321 and the second elastic arm 4322 may also be unparallel to each other.

Figure 4:
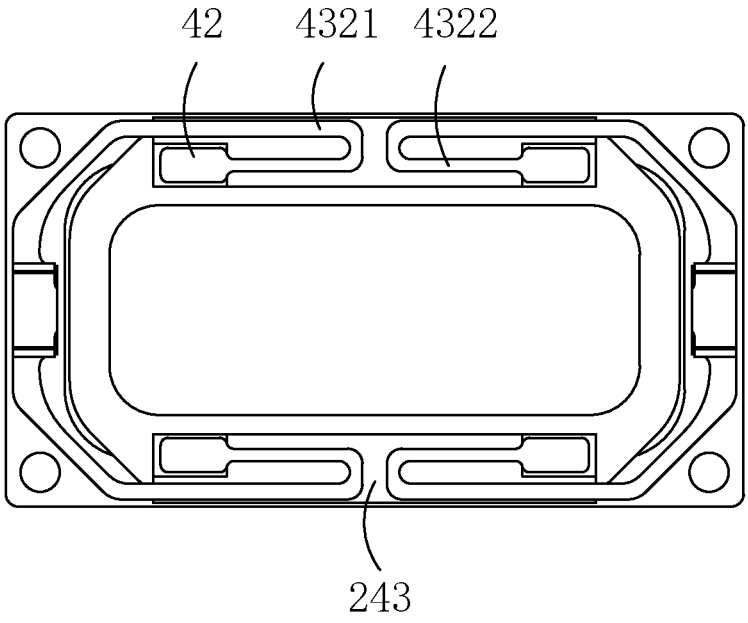
FIG. 4 is a plan view of the multi-function speaker according to the present disclosure.
Figure 5:
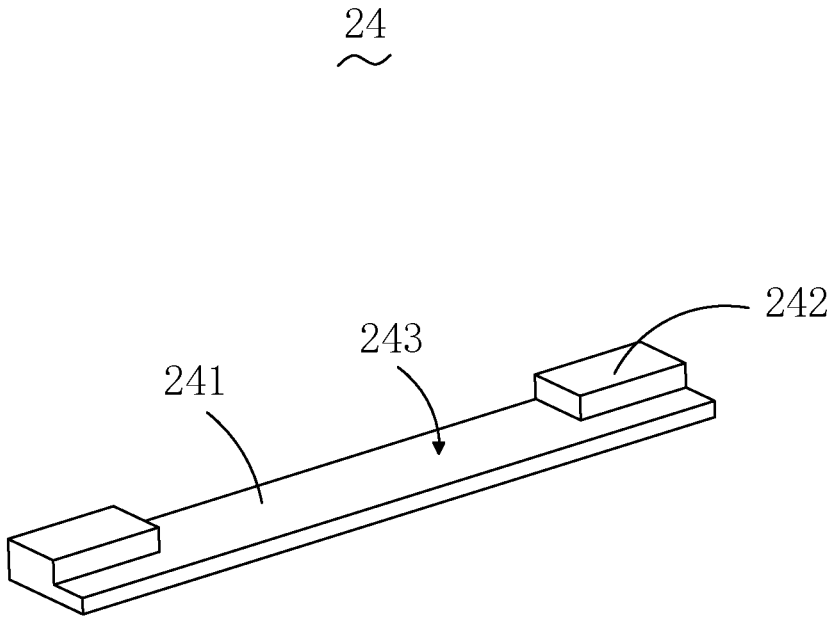
FIG. 5 is an isometric view of an upper plate as illustrated in FIG. 2.
Figure 6:
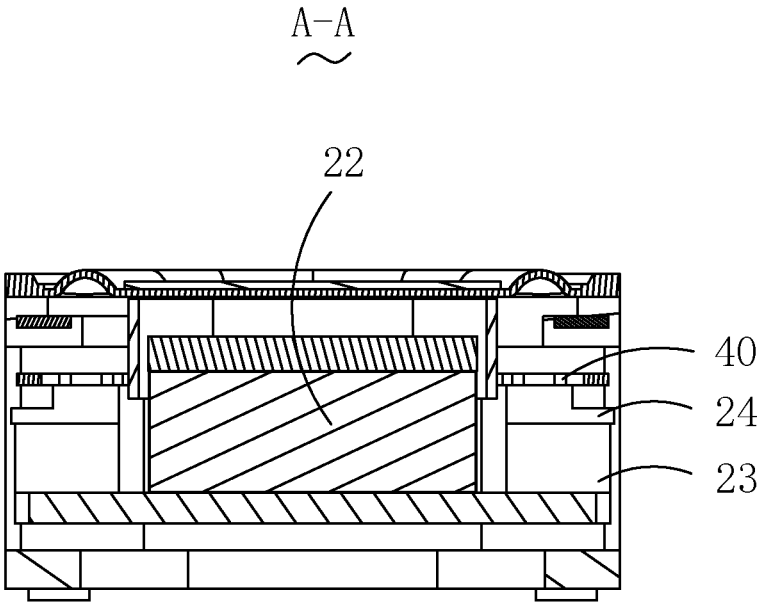
FIG. 6 is perspective view taken along line A-A as illustrated in in FIG. 1 according to the present disclosure.

As illustrated in FIG. 4 and FIG. 5, a projection of the first elastic arm 4321 on the main portion 241 in the vibration direction dose not overlap with a projection of the protrusion 242 on the main portion 241 in the vibration direction. The first elastic portion 431 is obliquely extended from both opposite ends of the first fixed portion 41 to connect the first elastic arm 4321. An obtuse angle is formed between the first elastic portion 431 and the first fixed portion 41. A avoidance portion 243 is formed at position on the main body portion 241 where the protrusion 242 is not disposed. Pprojections of the first elastic arm 4321, the second elastic arm 4322 and the first connecting arm 4323 on the main body portion 241 in the vibration direction fully fall in the avoidance portion 243.

Compared with the related art, on one hand, the elastic body of the multi-function speaker provided by the present disclosure has a long elastic arm, and can effectively reduce f0 when the elastic body drives the low-frequency vibration of the vibration system. And on the other hand, the avoidance portion of the lower plate is disposed to accommodating the elastic arm for providing sufficient vibration space for the elastic body and enhances the low-frequency vibration performance of the multi-function speaker.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A multi-function speaker, comprising:

a frame having a housing space, comprising:

two first side walls oppositely disposed to each other;

two second side walls oppositely and configured to connect two first side walls respectively;

a vibration system accommodated in the housing space;

a magnetic circuit system accommodated in the housing space, which comprises:

a lower plat;

a primary magnet disposed on the lower plate;

two secondary magnets disposed on both opposite sides of the primary magnet in a direction parallel to the second side wall;

an upper plate disposed on the secondary magnet, the upper plate comprises:

a main body portion disposed on the secondary magnet; and protrusions which protrude from both ends of the main body portion in the vibration direction and distal from the secondary magnet;

an elastic body fixed to the frame and configured to suspend the magnetic circuit system in the housing space, the elastic body comprises two elastic pieces of the same structure, and the elastic piece includes:

a first fixed portion fixedly connected to the first side wall;

a second fixed portion fixedly connected to the protrusion; and an elastic portion connected the first fixed portion and the second fixed portion, wherein the elastic portion comprises two first elastic portions extending from two opposite ends of the first fixed portion and a second elastic extending from one end of the first elastic portion, the second elastic portion comprises a first elastic arm proximal to the second side wall, a second elastic arm proximal to the primary magnet and a first connected arm configured to connect the first elastic arm and the second elastic arm, one end of the first elastic arm distal from the first connected arm connects the first elastic portion, one end of the second elastic arm distal from the first connected arm is connected to the second fixed portion.

2. The multi-function speaker according to claim 1, wherein the first elastic arm and the second elastic arm are parallel to the second side wall.

3. The multi-function speaker according to claim 1, wherein a projection of the first elastic arm on the body portion in vibration direction does not overlap with a projection of the protrusion on the main body portion in vibration direction.

4. The multi-function speaker according to claim 1, wherein the first elastic portion extends obliquely from both opposite ends of the first fixed portion to connect the first elastic arm, and an obtuse angle is formed between the first elastic portion and the first fixed portion.

5. The multi-function speaker according to claim 1, wherein a avoidance portion is formed at position on the main body portion where the protrusion is not disposed, and projections of the first elastic arm, the second elastic arm, and the first connected arm on the main body portion in a vibration direction fall within the avoidance portion.

6. The multi-function speaker according to claim 1, wherein two of the elastic pieces are symmetrically disposed on both sides of the multi-function speaker.

7. The multi-function speaker according to claim 1, wherein the height of the secondary magnet in the vibration direction is smaller than the height of the primary magnet in the vibration direction.

8. The multi-function speaker according to claim 5, wherein projections of the protrusion in a direction perpendicular to vibration direction and perpendicular to the second side wall completely fall within the primary magnet.

9. The multi-function speaker according to claim 1, wherein the multi-function speaker includes a connected body that connects the first fixed portion and the first side wall, and the connected body is embedded in the frame.

10. The multi-function speaker according to claim 1, wherein the frame includes an upper shell fixedly connected to the vibration system and a lower shell that is fixedly connected to the upper shell to form the housing space.

* * * * *